US005868508A

United States Patent [19]

Suzuki

[11] Patent Number: 5,868,508

[45] **Date of Patent: *Feb. 9, 1999**

[54] PRINTER STRUCTURE FOR FACILITATING INSTALLATION AND REMOVAL OF AN INK RIBBON CASSETTE

[75] Inventor: Kangi Suzuki, Shizuoka, Japan

[73] Assignee: Star Micronics Co., Ltd., Shizuoka-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 584,064

[22] Filed: Jan. 11, 1996

[30] Foreign Application Priority Data

Jan. 13, 1995 [JP] Japan ..... 7-020990
Jan. 13, 1995 [JP] Japan ..... 7-020992

[51] Int. Cl.[6] ..... B41J 29/02

[52] U.S. Cl. ..... 400/692; 400/208; 400/636

[58] Field of Search ..... 400/636, 637.1, 400/605, 639, 645, 645.4, 207, 208, 691, 692, 693

[56] References Cited

U.S. PATENT DOCUMENTS

| | | | |
|---|---|---|---|
| 4,784,504 | 11/1988 | Hamano et al. | 400/605 |
| 5,120,145 | 6/1992 | Kawahara | 400/637.1 |
| 5,165,810 | 11/1992 | Bazzani | 400/354 |
| 5,320,437 | 6/1994 | Malke et al. | 400/208 |
| 5,451,996 | 9/1995 | Awai et al.. | 400/207 |

*Primary Examiner*—Ren Yan
*Attorney, Agent, or Firm*—Pollock, Vande Sande & Priddy

[57] ABSTRACT

A printer simplifying a sheet feed mechanism, allowing feeding amount of a sheet to be constant regardless of thickness of the sheet, and facilitating installation of an ink ribbon cassette. The printer comprises a printing mechanism, a sheet feed mechanism, and a driving mechanism of the sheet feed mechanism which are respectively mounted on a chassis, wherein the printing mechanism and a driven roller of the sheet feed mechanism are mounted on a fixed frame fixed to the chassis, and driving rollers of the sheet feed mechanism and the driving mechanism of the sheet feed mechanism are supported on a swing frame swingably fixed to the chassis relative to the fixed frame. There is formed a space portion on the fixed frame for facilitating installation and removal of an ink ribbon cassette.

2 Claims, 9 Drawing Sheets

FIG. 7A (OPERATION OF CARRIAGE TRANSFER MOTOR 14)

FIG. 7B (DETECTION OF HOME POSITION)

FIG. 7C (TIMING PULSES)

FIG. 7D (OPERATION OF TRIGGER MAGNET 28)

PRINTER STRUCTURE FOR FACILITATING INSTALLATION AND REMOVAL OF AN INK RIBBON CASSETTE

BACKGROUND OF THE INVENTION

Field of the Invention

The present invention relates to a printer for use in printing characters on a sheet, such as a slip.

Description of the Prior Art

Conventionally there is a slip printer which prints characters on a sheet such as a slip as disclosed in JPU No. 62-150148 and JPY 2-8781.

In such a printer, a printing mechanism, a sheet feed mechanism, and a driving mechanism of the sheet feed mechanism are respectively mounted on a chassis, wherein one of feed rollers of the sheet feed mechanism is attached to a swing arm and a gap defined between the feed rollers is adjusted depending on a thickness of a sheet. There has been employed a method for transmitting torque from the chassis side to the feed rollers attached to the swing arm by way of a gear train. In such a case, when the inclination angle of the swing arm is changed depending on the thickness of a sheet, an interval between a shaft of the gear train on the chassis and a shaft of the swing arm is changed, which leads to a change of backlash of the gears. As a result, there is a drawback in that the feeding amount of the sheet is changed.

Since the gear train for transmitting torque from the chassis side to the feed rollers attached to the swing arm extends over two members, it causes a drawback in that the sheet feed mechanism is complex and adjustment of meshing of the gears is troublesome in assembling the printer.

Further, as exemplified in the printer disclosed in JPU No. 62-150148, driving rollers and driven roller constituting the sheet feed mechanism are disposed at a front side of the printing mechanism, namely, at the discharge side of the slip since the slip printer can print characters on the slip to an extent of an end portion thereof in the longitudinal direction thereof, namely, in a feeding direction. Accordingly, in installing an ink ribbon cassette, both arm portions of the ink ribbon cassette need to be moved from the sheet feed mechanism to the printing mechanism so as to insert an ink ribbon through a narrow gap portion defined between a print head and a platen of the printing mechanism. As is well known, an ink ribbon is soft and extends over arm portions of the ink ribbon cassette and can be freely drawn out. There is a possibility that such an ink ribbon is caught by an end of a frame or a concave or convex portion formed in a tip end of the print head, etc., and it is troublesome to install or remove the ink ribbon cassette in a conventional printer having the sheet feed mechanism or the printing mechanism exposed. If the ink ribbon is picked up by a hand so as to be led between the print head and the platen, the hands are made dirty. Even if the ink ribbon cassette is installed, there is another problem in that it is difficult to confirm whether the ink ribbon cassette is appropriately positioned or not.

If printing is performed in a state where the ink ribbon is loosened while it remains caught by the frame etc., there is a likelihood that the ink ribbon is rammed between a print head and a document table, which prevents normal feed of a slip, resulting in a feed failure or a paper jam. Further, if such problem occurs, there is a drawback in that it is difficult to confirm such problem.

SUMMARY OF THE INVENTION

It is therefore an object of the present invention to provide a printer capable of simplifying a sheet feed mechanism and allowing the feeding amount of a sheet to be constant regardless of the thickness of the sheet.

It is another object of the present invention to provide a printer capable of facilitating installation or removal of an ink ribbon cassette and also facilitating confirmation of condition of the ink ribbon cassette on the printing mechanism.

As shown in FIGS. 1 and 2, the printer according to a first aspect of the present invention is characterized in that it is provided with a printing mechanism, a sheet feed mechanism, and a driving mechanism (a gear train and a driving motor) of the sheet feed mechanism which are respectively mounted on a chassis, wherein the printing mechanism and a driven roller of the sheet feed mechanism are supported on a fixed frame fixed to the chassis, and driving rollers of the sheet feed mechanism and the driving mechanism (gear train and a driving motor) of the sheet feed mechanism are supported on a swing frame swingably fixed to the chassis relative to the fixed frame. Accordingly, in the printer of the present invention, the swing frame is swingably fixed to the chassis where the fixed frame is fixed. The driven roller of the sheet feed mechanism and the printing mechanism are supported on the fixed frame. Further, the driving rollers corresponding to the driven roller and the driving mechanism for applying torque to the driving rollers are mounted on the swing frame independently of the fixed frame. Accordingly, when a sheet is inserted between the driving rollers and driven roller, the swing arm is merely changed in its inclination angle relative to the fixed frame according to the thickness of the sheet, and hence it does not at all affect the gear train of the sheet feed mechanism. As a result, the feeding amount of the sheet is not changed and remains constant regardless of the thickness of the sheet.

Further, a printer according to a second aspect of the invention is characterized in that, in the first aspect of the invention, the fixed frame is fixed to the chassis, and the swing frame is swingably fixed to the chassis by way of a supporting shaft, and the driving mechanism is fixed to the swing frame for applying torque to the driving rollers. That is, the swing frame is rotatably supported by the supporting shaft on the chassis, and it can be changed in its inclination angle relative to the fixed frame when it rotates. As a result, the interval between the driving rollers and the driven roller can be changed as necessity requires.

A printer according to a third aspect of the invention is characterized by further comprising a pushing up mechanism disposed on the chassis for pushing up the swing frame toward the fixed frame. Since the swing frame is pushed up toward the fixed frame by the pushing up mechanism, the driving rollers and the driven roller remains pressed against each other with a constant pressure regardless of the thickness of the sheet. As a result, the sheet can be stably fed.

A printer according to a fourth aspect of the invention is characterized by further comprising a cam mechanism disposed between the chassis and the swing frame for separating the driving rollers of the swing frame from the driven roller. That is, the inclination angle between the swing frame and the fixed frame is changed by the cam mechanism so as to separate the driving rollers from the driven roller. As a result, the ink ribbon can be easily passed between the driving rollers and the driven rollers. In this case, the swing frame can be interlocked with the cam mechanism, and can be inclined in its inclination angle relative to the fixed frame when the cam rotates. With the frame is inclined, an interval between the driving rollers and driven roller is increased, and at the same time, a gap at the printing mechanism side, namely, a gap defined between the print head and the platen is also increased.

A printer according to a fifth aspect of the invention is characterized by comprising a printing mechanism, a sheet feed mechanism and a driving mechanism of the sheet feed mechanism respectively mounted on a chassis, wherein the printing mechanism and a first roller of the sheet feed mechanism are supported on a fixed frame fixed to the chassis, a second roller of the sheet feed mechanism is supported on a swing frame swingably fixed to the chassis relative to the fixed frame, a head cover is fixed to the fixed frame for enveloping the printing mechanism, a space portion is defined at the periphery of the lower portion of the head cover for facilitating installation and removal of an ink ribbon cassette, and a gap is defined between the first roller and the second roller of the sheet feed mechanism in accordance with an inclination of the swing frame relative to the fixed frame. That is, according to this printer, the fixed frame is fixed to the chassis, and the printing mechanism is provided on the fixed frame, and the first roller of the sheet feed mechanism is provided at the discharge side of the sheet. The printing mechanism is enveloped by the cover attached to the fixed frame, and a space portion is defined at the periphery of the cover. When the ink ribbon cassette is inserted in the space portion, it can be easily installed in the printing mechanism.

In this case, the swing frame is fixed to the chassis by way of the supporting shaft. The second roller of the sheet feed mechanism are supported on the swing frame. When the swing frame is turned about the supporting shaft so as to be inclined relative to the chassis, the interval between the first rollers and the second roller is increased. At this time, there is defined a large gap at the printing mechanism side, namely, between the print head and the platen compared with a gap defined at printing operation, through which the inside of the printing mechanism can be seen. Accordingly, the ink ribbon which extends over both arm portions of the ink ribbon cassette is smoothly inserted through the interval between the first roller and the second roller, and is further smoothly inserted into the gap defined between the print head and the platen. It is possible to see the ink ribbon of the installed ink ribbon cassette through the space portion formed at the periphery of the cover.

A printer according to a sixth aspect of the invention is characterized in that, in the fifth aspect of the invention, the first roller is attached to the cover. That is, since the first roller is attached to the cover which envelopes the printing mechanism fixed to the fixed frame, the space portion for facilitating insertion of the ink ribbon cassette can be enlarged so as to define a gap through which the installed ink ribbon cassette can be seen. As a result, the condition of the installed ink ribbon cassette can be easily confirmed.

A printer according to a seventh aspect of the invention is characterized in that the printer according to the fifth aspect of the invention further comprises a cam mechanism disposed between the chassis and the swing frame for separating the driving rollers of the swing frame from the driven roller, wherein an installation/removal mode of the ink ribbon cassette is set upon reception of an installation/removal instruction and a carriage is transferred to a home position when a carriage transfer motor is operated, wherein the cam mechanism is rotated by the carriage transfer motor in synchronism with the transfer of the carriage, thereby separating the second roller from the first roller.

With such an arrangement, when the installation/removal mode is set based on the installation/removal instruction, the printing mechanism moves to a position to allow installation/removal of the ink ribbon cassette. At the same time, there is formed a space portion for the ink ribbon cassette. Accordingly, the ink ribbon cassette can be easily installed in the printing mechanism and the condition of the installed ink ribbon cassette can be easily confirmed so as to prevent the ink ribbon cassette from being erroneously installed.

A printer according to an eighth aspect of the invention is characterized in that in the printer according to the fifth aspect of the invention, a print head of the print mechanism is positioned within the width of the lower portion of the head cover when the gap is defined between the first roller and the second roller in accordance with the inclination of the swing frame. When the ink ribbon cassette is installed, the ink ribbon can be quickly and surely inserted into a gap between the print head and the paten while the ink ribbon is not caught by the print head.

DETAILED DESCRIPTION OF THE PREFERRED EMBODIMENTS

Figure 1:
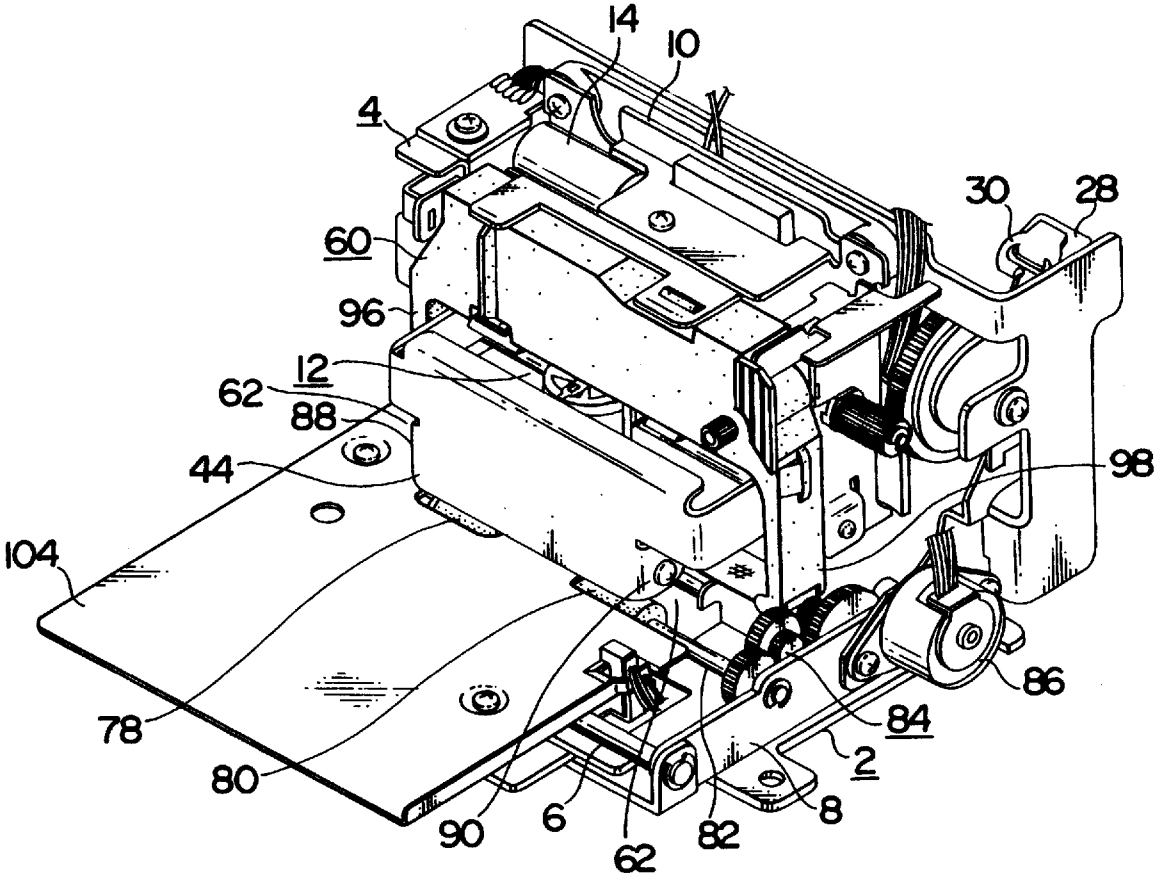
FIG. 1 is a perspective view of a printer according to a preferred embodiment of the present invention.
Figure 2:
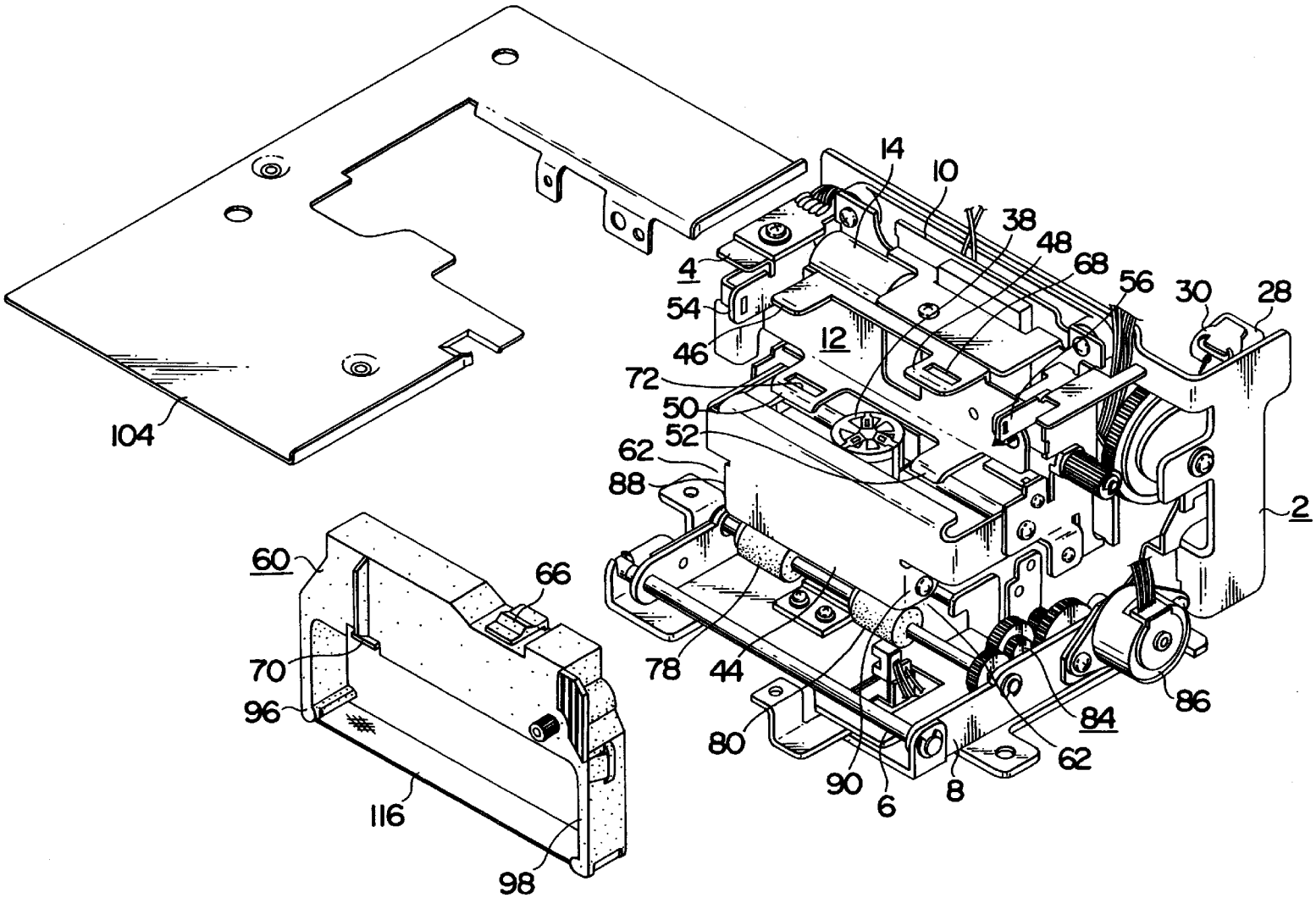
FIG. 2 is an exploded perspective view of the printer in FIG. 1.

A printer according to a preferred embodiment of the present invention will be now described in detail.

FIGS. 1 through 4 show the printer according to the preferred embodiment. The printer is a slip printer comprising an L-shaped chassis 2, a fixed frame 4 constituting side frames mounted on the chassis 2, a swing frame 8 supported by a supporting shaft 6 so as to be turned thereabout. The swing frame 8 constitutes a lever mechanism having the supporting shaft 6 as its fulcrum.

A control circuit board 10 and a print mechanism 12 are respectively fixed to the fixed frame 4. That is, a carriage transfer motor 14 is fixed to the fixed frame 4, and torque of the carriage transfer motor 14 is transmitted to a carriage driving shaft 16 by way of a gear train. A gear 18 is attached to the carriage driving shaft 16, and a gear 20 attached to the chassis 2 meshes the gear 18. Cams 22 and 24 serving as a cam mechanism are attached to the gear 20. A movable arm 30 is provided so as to be operable by a trigger magnet 28 to move to or away from a protrusion 26 of the cam 22, and tension is applied to the movable arm 30 by a spring 32. When the trigger magnet 28 is not energized, a tip portion of the movable arm 30 is retained by the protrusion 26 so that the cam 22 is prevented from rotating by the spring 32.

The cam 24 has a short diameter portion and a long diameter portion about a supporting shaft 34 as its rotary center. An operation portion 36 of the swing frame 8 contacts a working surface of the cam 24. That is, when the trigger magnet 28 is energized, the retention between the movable arm 30 and the cam 22 is released so that the rotation of the gear 20 is transmitted to the cam 24. At this time, the operation portion 36 is pressed downward when it contacts the long diameter portion of the cam 24 owing to the rotation of the cam 24.

The print mechanism 12 has a print head 38 which is controlled by the carriage transfer motor 14 in its horizontal movement. A carriage 40 having the print head 38 thereon is slidably supported by a supporting shaft 42 which is fixed to the fixed frame 4. A head cover 44 serving as a cover for enveloping the print mechanism 12 is attached to the fixed frame 4. The head cover 44 is U-shaped so as to protrude in front of the fixed frame 4, and guide pieces 46, 48, 50, 52, 54, and 56 respectively protruding from the fixed frame 4 are disposed at the periphery of the head cover 44. A retaining hole 68 is defined in the guide piece 48 for retaining a retaining projection 66 of an ink ribbon cassette 60 therein, and fixing the same thereto. Likewise, a retaining hole 72 is defined in the guide piece 50 for retaining a retaining projection 70 provided at the lower side of the ink ribbon cassette 60 therein and fixing the same thereto. A width between both side portions of the head cover 44 at the lower portion thereof is formed narrowly, and a space portion 62 is defined between the outer periphery of the lower portion of the head cover 44 and the ink ribbon cassette 60.

A driven roller 92 as a first roller corresponding to the driving rollers 78 and 80 is supported by a supporting shaft 94 between bearings 88 and 90 at the side portions of the head cover 44 fixed to the fixed frame 4. On the other hand, a platen 74, the driving rollers 78 and 80 as a second roller in a sheet feed mechanism 76 and a driving mechanism thereof are respectively disposed on the side of the swing frame 8, wherein the driving rollers 78 and 80 are supported by a driving shaft 82. The driving mechanism comprises a gear train 84 and a driving motor 86. Torque of the driving motor 86 is applied to the driving shaft 82 by way of the gear train 84. In the preferred embodiment, the driving motor 86 is attached to the swing frame 8 in the manner of protruding outside the swing frame 8. In this case, an interval between the bearings 88 and 90 formed on the head cover 44 corresponds to a width between the driving rollers 78 and 80, i.e., a width of a slip to be transferred, and it is formed to be narrower than the interval between arm portions 96 and 98 of the ink ribbon cassette 60. Accordingly, there is defined a space portion, i. e., a gap between inner sides of the arm portions 96 and 98 and outer surfaces of the bearings 88 and 90.

A pushing up mechanism 100 is disposed on the chassis 2 for pushing up the swing frame 8 toward the fixed frame 4. That is, a spring 102 is inserted between the chassis 2 and the swing frame 8 in a compressed state, so that the swing frame 8 is pushed upward by the spring 102. As a result, the driving rollers 78 and 80 are pressed against the working surface of the driven roller 92 by way of the slip to be transferred.

A document table 104 serving as a guide plate is disposed on the chassis 2 so as to be interposed between the fixed frame 4 and the swing frame 8. The document table 104 is a guide means for inserting the slip to be printed between the driving rollers 78 and 80 and the working surface of the driven roller 92.

Figure 5:
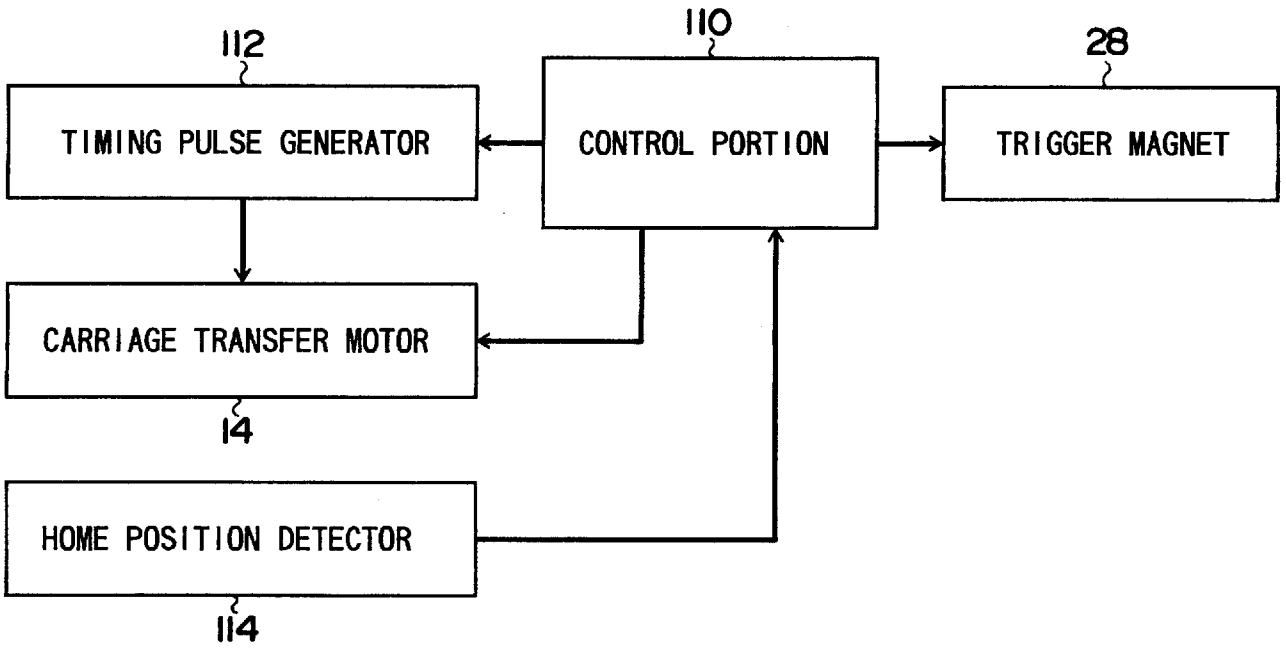
FIG. 5 is a block diagram of a control unit of the printer in FIG. 1.

FIG. 5 shows an arrangement of a control unit of the printer as shown in FIGS. 1 through 4. A control portion 110 comprises a microcomputer composed of a CPU, a ROM and a RAM, an input/output unit, etc. and it is connected to a host computer, not shown. A control output issued by the control portion 110 is supplied to a timing pulse generator 112, the carriage transfer motor 14 and the trigger magnet 28. The timing pulse generator 112 generates timing pulses for rotating the carriage transfer motor 14. The carriage transfer motor 14 is a driving means of the carriage on which the print head is mounted, and its rotation is controlled by the control portion 110. The trigger magnet 28 is a means for applying torque to the cam 24 for turning the swing frame 8. A home position detector 114 is provided as a means for detecting a home position of the carriage 40, namely, detecting whether the carriage 40 is positioned at the left end position or not, and a detected output is applied to the control portion 110.

With such an arrangement, since the gear train 84 together with the driving rollers 78 and 80 of the sheet feed mechanism 76 are disposed on the swing frame 8, even if the interval between the driving rollers 78 and 80 and the driven roller 92 is changed corresponding to thickness of the slip, meshing of the gears of the gear train 84 remains unchanged. That is, the interval between the shafts of the gear train 84, namely, meshing of the gears remains constant in a given interval, and hence feeding amount of the sheet is unrelated to the thickness of the sheet.

The sheet feed mechanism 76 is integrally mounted on the swing frame 8 except for the driven roller 92 that is supported on the fixed frame 4, independently of the mechanism on the fixed frame 4, it can be manufactured and assembled independently.

Installation and removal of the ink ribbon cassette 60 will be now described. The swing frame 8 is inclined about the supporting shaft 6 for preparing insertion of an ink ribbon 116 so as to increase the interval between the driving rollers 78, 80 and the driven roller 92.

Figure 6:
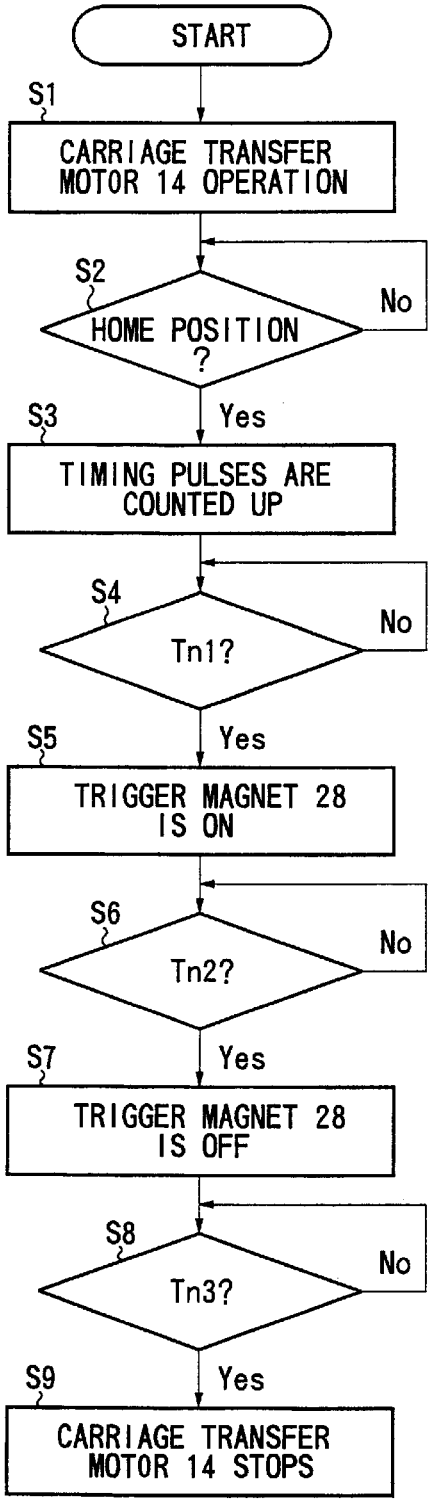
FIG. 6 is a flow chart showing the operation of the printer in FIG. 1 when an ink ribbon cassette is installed in or removed from the printer.
Figure 7:
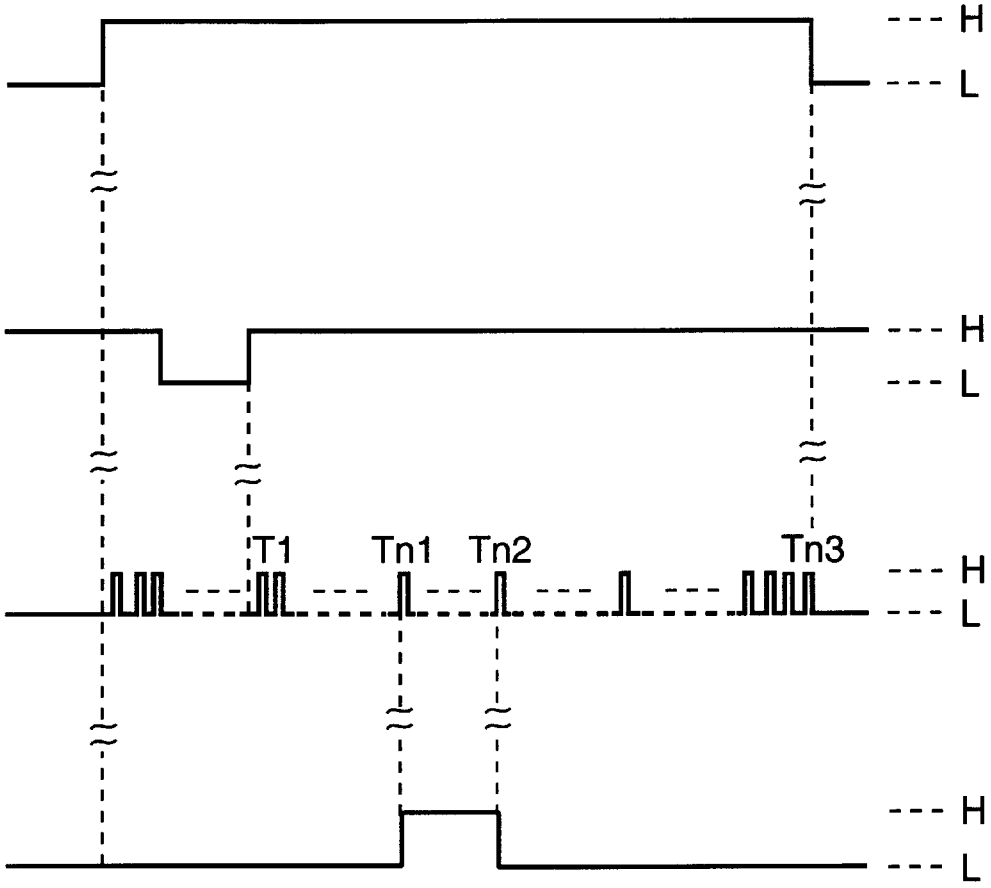
FIGS. 7A–7D (hereinafter collectively referred to as "Fig 7") are a timing chart showing the operation of the printer in FIG. 1 when an ink ribbon cassette is installed in or removed from the printer.

FIG. 6 shows a flowchart of an expanding operation of the swing frame 8, and FIG. 7 shows an operation timing thereof.

When the ink ribbon cassette 60 is installed or removed, an instruction is issued to permit the printer to be in an installation/removal mode. At this time, in step S1, the carriage transfer motor 14 is operated. FIG. 7A shows an operating period of the carriage transfer motor 14. In step S2, the control portion 110 detects whether the carriage 40 is transferred to the home position or not. FIG. 7B shows a detected output of the home position detector 114, wherein an L level period represents that the carriage 40 arrives at the home position. When the carriage 40 arrives at the home position, the program goes to a step S3 where timing pulses are counted as shown in FIG. 7C. In FIG. 7C, T1, Tn1, Tn2 . . . Tn3 represent counted values of the timing pulses.

In step S4, when the timing pulses reach the given counted value Tn1, the program goes to a step S5 where the trigger magnet 28 starts its energization. In step S6, when the timing pulses reach the counted value Tn2 counting from the start of energization of the trigger magnet 28, the program goes to a step S7 where the energization of the trigger magnet 28 is released. In FIG. 7D, an H level period represents the energization period of the trigger magnet 28 wherein the other end of the movable arm 30 is attracted to the trigger magnet 28 against the spring 32 and it is released in its retention with the cam 22.

In step S8, the control portion 110 judges whether the timing pulses reach the counted value Tn3 or not. When the timing pulses reaches the counted value Tn3, the program goes to a step S9 where the carriage transfer motor 14 is stopped.

With such a series of operations, the carriage transfer motor 14 starts its rotation upon reception of an installation/removal instruction of the ink ribbon cassette 60, and the number of the timing pulses is counted. When the number of the timing pulses reach the counted value Tn3, the rotation of the carriage transfer motor 14 is stopped. The trigger magnet 28 is energized during the period from the counted value Tn1 to Tn2, and at this time torque of the carriage transfer motor 14 is transmitted to the cam 24. The counted value Tn3 is set as to allow the print head 38 to move from the home position to a predetermined position, for example, the center within the width of the lower portion of the head cover 44. The counted value Tn1 is set as to allow the long diameter portion of the cam 24 to reach the operation portion 36 of the swing frame 8 when the timing pulses reach the counted value Tn3 or the carriage transfer motor 14 is stopped. The counted value Tn2 is set equal to a counted value from when the timing pulses reach the counted value Tn1 or the trigger magnet is energized to when the movable arm 30 is released in its engagement with the cam 22.

Figure 3:
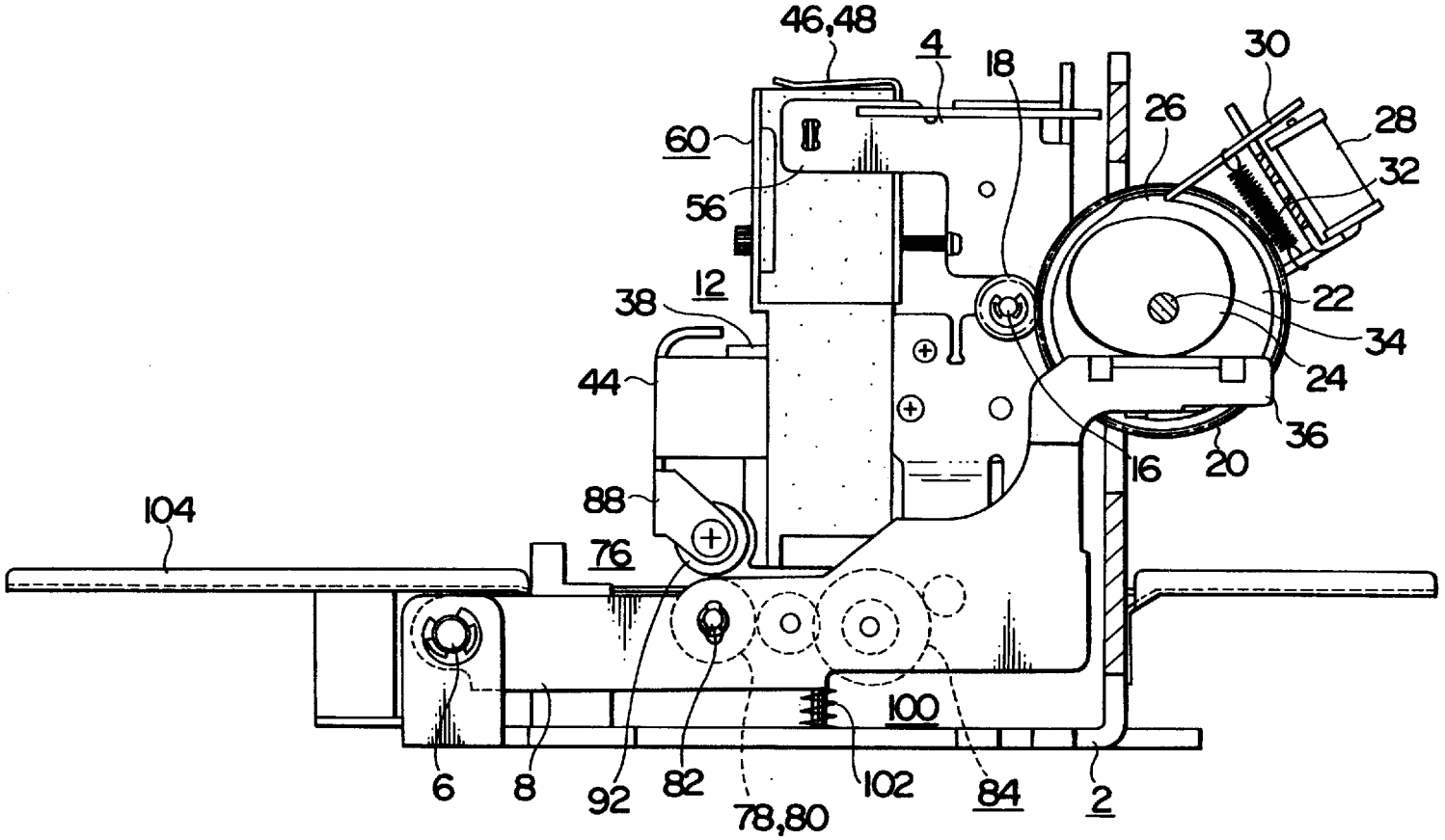
FIG. 3 is a partly cut away side view of the printer in FIG. 1.
Figure 4:
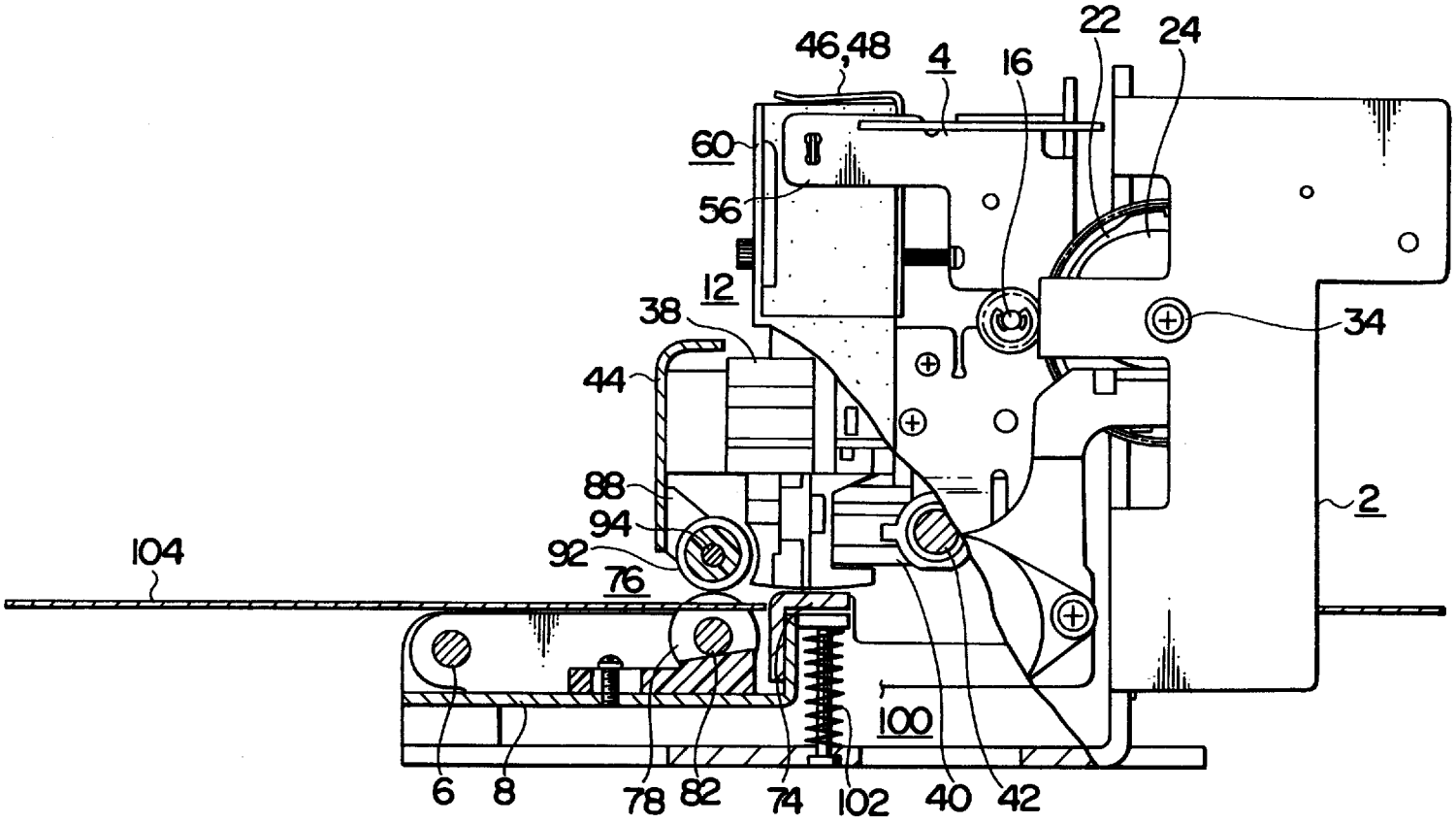
FIG. 4 is another partly cut away side view of the printer in FIG. 1.

That is, as shown in FIG. 3, although the movable arm 30 is retained by the cam 22, when the movable arm 30 is moved away from the cam 22 due to the energization of the trigger magnet 28, the cam 22 starts its rotation. The cam 24 rotates at the same time when the cam 22 rotates, and the rotation of the cam 24 continues until the carriage transfer motor 14 stops.

Figure 8:
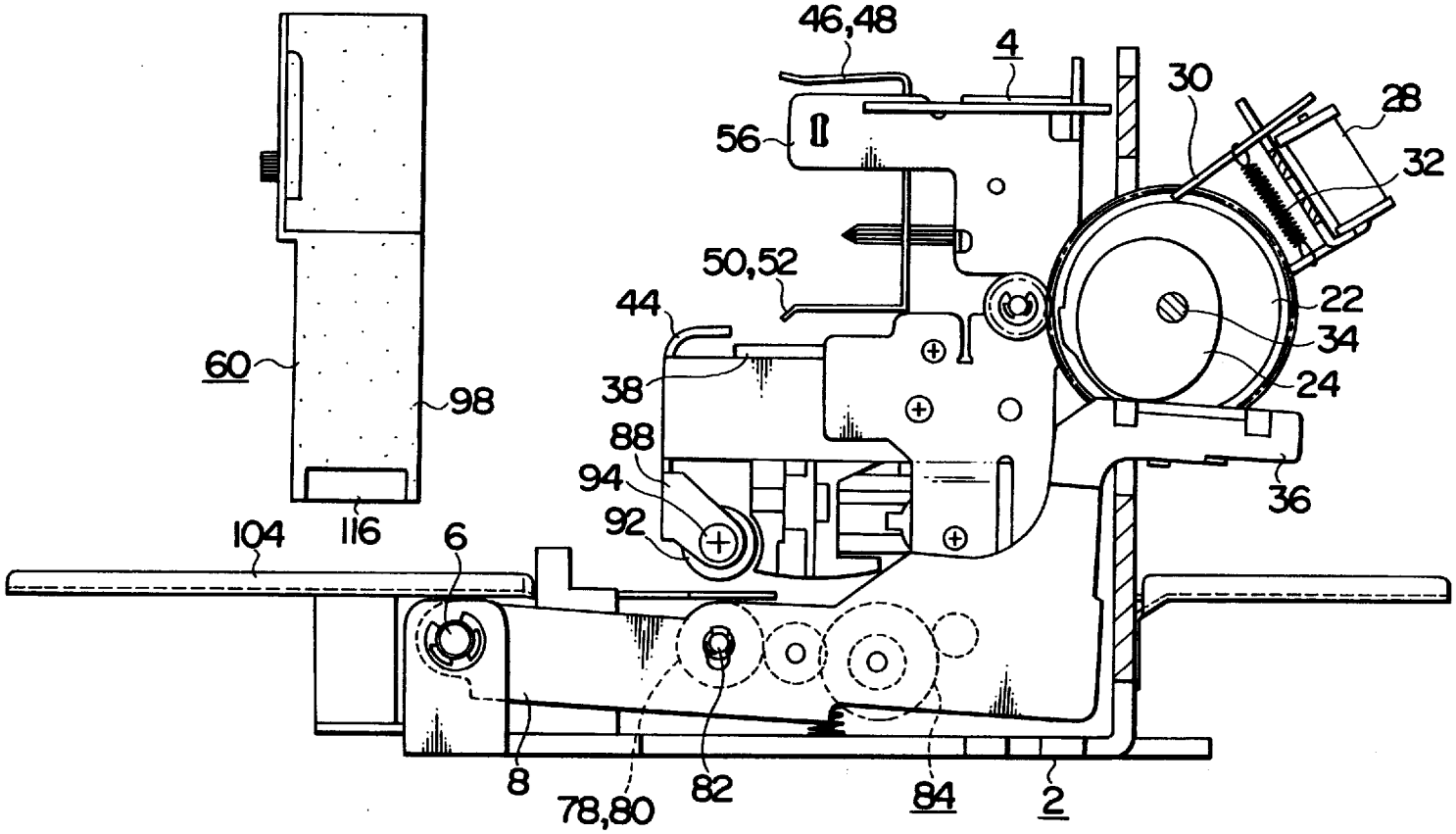
FIG. 8 is a partly cut away side view of the printer showing the state in an installation/removal mode of the ink ribbon cassette.

When the cam 24 rotates and its long diameter portion arrives at an operation portion 36 of the swing frame 8 as shown in FIG. 8, the operation portion 36 of the swing frame 8 is pushed downward so that the swing frame 8 turns about the supporting shaft 6 by the pushing downward length of the operation portion 36, so that the driving rollers 78 and 80 move downward. At this time, the rotation of the carriage transfer motor 14 is stopped. As a result, an interval between the driving rollers 78 and 80 and the driven roller 92 is opened or increased, so as to allow the ink ribbon 116 of the ink ribbon cassette 60 to pass therethrough.

Figure 9:
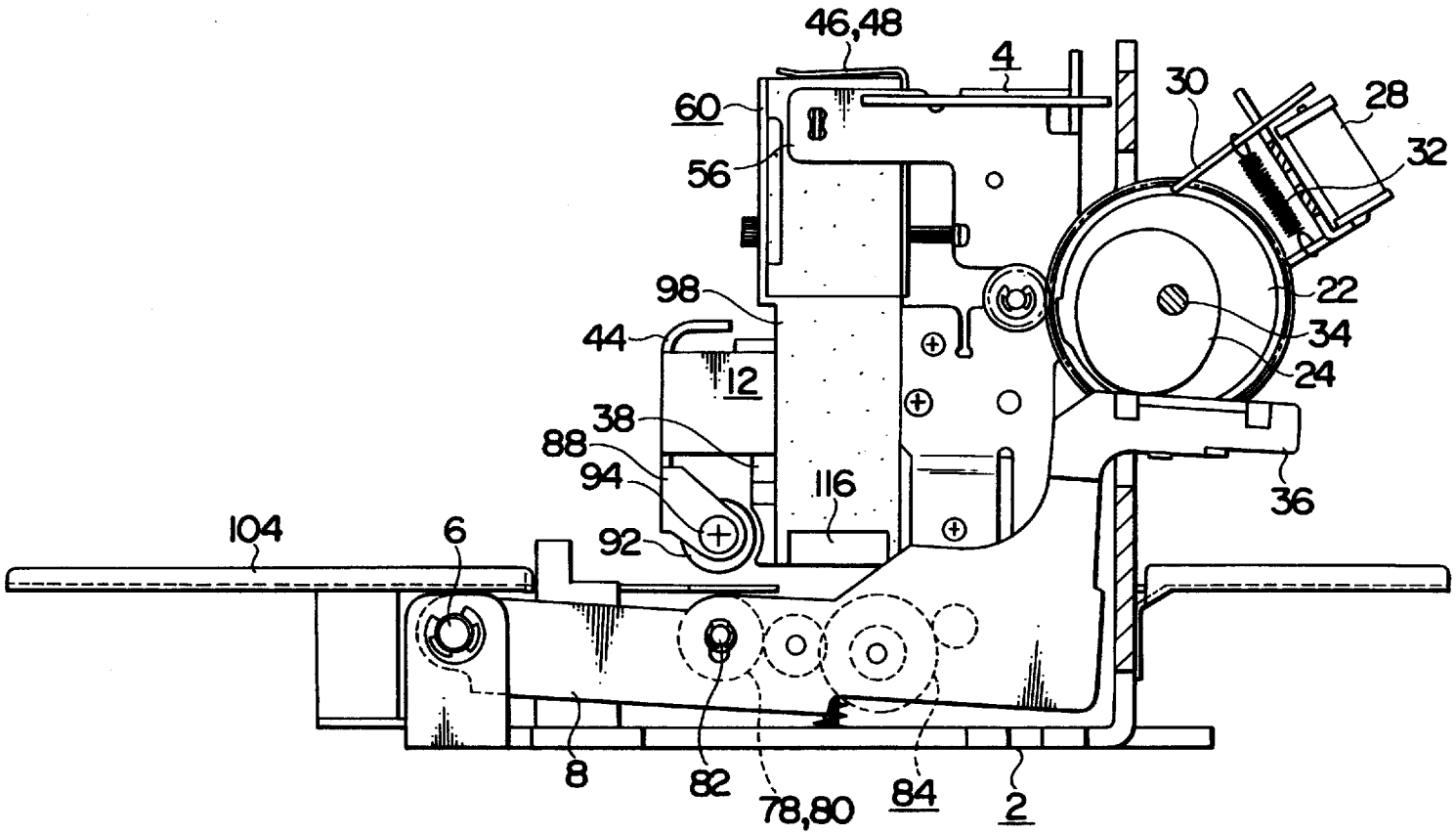
FIG. 9 is another partly cut away side view of the printer showing a state where the ink ribbon cassette is installed in the printer.

In this state, the ink ribbon cassette 60 is inserted into the peripheral portion of the head cover 44 so as to position the head cover 44 between the arm portions 96 and 98 of the ink ribbon cassette 60. At this time, the ink ribbon 116 of the ink ribbon cassette 60 is passed through the interval between the driving rollers 78 and 80 and the driven roller 92, and is then inserted between the print head 38 of the printing mechanism 12 and the platen 74. FIG. 9 shows a state where the ink ribbon cassette 60 is installed in the printing mechanism.

The print head 38 is enveloped by the head cover 44 after the head cover 44 is disposed on the fixed frame, so that the concave and convex portions provided in the tip portion of the print head are all covered with the head cover 44, and hence the ink ribbon is not caught by such concave and convex portions. Since the space portion 62 is defined between side walls of the bearings 88 and 90 of the head cover 44 and the inner sides of the arm portions 96 and 98 of the ink ribbon cassette 60, the ink ribbon cassette 60 can be easily and quickly installed in the printing mechanism while the ink ribbon 116 is not caught by any portions of the printing mechanism.

When the ink ribbon cassette 60 is installed or removed, the print head 38 is moved to a new position, for example to the center. When the print head 38 is moved to the center, the swing frame 8 is turned so as to set an interval between the driving rollers 78 and 80 and the driven roller 92 for allowing the ink ribbon 116 to pass therethrough. Further, when such an interval is set, the swing frame 8 moves downward, which does not cause any inconvenience for inserting the ink ribbon 116 and for installing the ink ribbon cassette 60, but facilitates the installation and removal of the ink ribbon cassette 60.

The bearings 88 and 90 of the driven roller 92 attached to the head cover 44 correspond to the driving rollers 78 and 80 and also correspond to the width of the slip to be printed. Accordingly, there is defined a gap between outer surfaces of the bearings 88 and 90 of the driven roller 92 and the inner sides of the arm portions 96 and 98 of the installed ink ribbon cassette 60. It is possible to visibly confirm condition of the ink ribbon 116 of the installed ink ribbon cassette 60 through this gap so as to prevent the start of printing in the inferior installation condition of the ink ribbon cassette 60.

Since the head cover 44 envelopes the print head 38 which generates heat when printing, it is heated by the heat generated by the print head 38. However, when the head cover 44 is formed of a metallic plate together with fixed frame 4, a radiating area of the print head 38 for radiating heat is increased so that the print head 38 is cooled, which contributes to prevention of overheating of the print head 38.

The following effects can be obtained by the present invention.

a. Since the sheet feed mechanism is provided on the swing frame except the driven roller, the gear train of the sheet feed mechanism is provided on the swing frame, so that the interval between the shafts of the gear train is not changed even if the interval between the driving rollers and the driven roller is changed depending on the thickness of the sheet, whereby a constant backlash is maintained. As a result, the sheet can be stably fed without changing the feeding amount of the sheet.

b. Since the swing frame constitutes a lever mechanism, the interval between the driving rollers and the driven roller can be increased with a simple cam mechanism, so that the ribbon cassette can be easily installed or removed and the sheet can be easily removed when it is jammed.

c. Since the printing mechanism is enveloped by the cover, and the space portion is defined at the peripheral portion of the cover for facilitating installation and removal of the ink ribbon cassette, the ink ribbon cassette can be easily and quickly installed or removed, which enhances operability of the installation and removal of the ink ribbon cassette. As a result, it is possible to prevent the ink ribbon from being caught by the printing mechanism when the ink ribbon cassette is installed or removed, and also possible to prevent the ink ribbon from being loosened when the ink ribbon cassette is inferiorly installed, so as to enhance reliability of the printing operation.

d. When the ink ribbon cassette is installed or removed, the swing frame is lowered so as to increase the interval between the driving rollers of the swing frame and the driven roller, which makes it possible to easily insert the ink ribbon of the ink ribbon cassette, and also possible to enhance operability of the installation or removal of the ink ribbon cassette.

e. Since the space portion for facilitating installation/removal of the ink ribbon cassette is formed at the peripheral portion of the cover for enveloping the printing mechanism, and the driven roller corresponding to the driving rollers is attached to the cover, it is possible to define a gap between the bearings of the driven roller and the arm portions of the installed ink ribbon cassette. Therefore, it is possible to easily confirm condition of the ink ribbon of the installed ink ribbon cassette through this gap, which results in prevention of inferior installation of the ink ribbon cassette in advance.

f. When the installation/removal mode is set by the instruction of the ink ribbon cassette, the printing mechanism moves to the specified position to thereby automatically form a necessary interval, so that the ink ribbon cassette can be easily and quickly installed, and erroneous installation thereof can be prevented beforehand.

g. Since the print head of the print mechanism is positioned within the width of the lower portion of the head cover when the interval between the driving rollers and the driven roller is increased in accordance with the inclination of the swing frame, the ink ribbon cassette can be easily installed or removed, particularly the ink ribbon can be quickly and surely inserted in the gap between the print head and the platen while the ink ribbon is not caught by the print head.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A printer comprising:

a printing head movably mounted on a fixed frame of a chassis;

a head cover fastened to the fixed frame for shielding the printing head;

a removable ink ribbon cassette slidingly inserted into a surrounding space of the head cover;

a first roller of a sheet feeding mechanism fixedly mounted to the head cover and extending across an interior surface of the cover;

a swing frame pivotally connected to the chassis relative to the fixed frame;

a second roller of the sheet feeding mechanism rotationally mounted to the swing frame for driving the first roller;

a space existing between the installed cassette and the periphery of the cover to avoid snagging of the ribbon upon insertion or removal of the cassette; and a gap defined between the first and second rollers when the swing frame is rotationally displaced relative to the fixed frame to allow installation and removal of a cassette.

2. The printer according to claim 1 further comprising:

a cam mechanism disposed between the chassis and the swing frame;

a swing frame mounted motor means for a) actuating the cam mechanism and causing rotational displacement of the swing frame from the fixed frame and correspondingly separating the first and second rollers to allow non interfering insertion of the cassette into the surrounding space of the cover; and b) displacing the head to a predetermined position inside the cover to avoid snagging of the ribbon of an inserted or removed cassette.

* * * * *